United States Patent [19]

Rother et al.

[11] Patent Number: 4,901,448

[45] Date of Patent: Feb. 20, 1990

[54] SUSPENSION PREHEATER

[75] Inventors: Wolfgang Rother, Oelde; Heinz-Herbert Schmits, Rheda-Wiedenbruck; Heinz-Werner Thiemeyer, Ennigerloh, all of Fed. Rep. of Germany

[73] Assignee: Krupp Polysius AG, Fed. Rep. of Germany

[21] Appl. No.: 334,186

[22] Filed: Apr. 6, 1989

[30] Foreign Application Priority Data

May 20, 1988 [DE] Fed. Rep. of Germany ..... 3817355

[51] Int. Cl.[4] ..... F26B 19/00

[52] U.S. Cl. ..... 34/85; 34/86; 432/106

[58] Field of Search ..... 34/85, 82, 86; 432/106

[56] References Cited

U.S. PATENT DOCUMENTS 2,797,077 6/1957 Muller ..... 34/85 X 4,402,667 9/1983 Goldmann ..... 432/106 X

*Primary Examiner*—Henry A. Bennet

*Attorney, Agent, or Firm*—Learman & McCulloch

[57] ABSTRACT

The invention relates to a suspension heat exchanger for heat exchange between gas and fines. It contains a plurality of cyclone separators which lie one above another with their axes aligned vertically and in which the cover walls and the inlet pipe connections of the substantially straight upper parts of the cyclones are inclined at an acute angle with respect to the horizontal. This contributes to a particularly simple and space-saving overall construction and to a favourable material separation with relatively low pressure loss.

9 Claims, 1 Drawing Sheet

SUSPENSION PREHEATER

The invention relates to a suspension preheater for heat exchange between gas and fines before a kiln, according to the preamble to claim 1.

Suspension preheaters of the aforesaid type are widely known in the art. They have many uses, for example in the cement, lime and gypsum industries and in the preparation of ore materials.

Furthermore, a cyclone preheater construction is known from DE-A No. 11 54 768 in which centrally arranged cyclone separators of large diameter and of essentially conventional construction are provided in each case in individual stages as well as a plurality of outer cyclone separators having a small diameter with cover walls and feed pipes inclined downwards in the flow direction, and a special distributing device which is connected on the one hand to the pipes leading to the outer cyclones and on the other hand to a material outlet pipe from the next uppermost central cyclone separator is connected to each central cyclone separator.

The object of the invention is to make further developments to a suspension preheater of the type set out in the preamble to claim 1 in such a way that it is of relatively simple construction both as regards the construction of the individual cyclone separators and the overall construction and can operate particularly favourably as regards the pressure losses and the dust collection.

This object is achieved according to the invention by the features set out in the characterising portion of claim 1. Particularly advantageous embodiments and variants of the invention are the subject matter of the subordinate claims.

This construction of all the cyclone separators according to the invention with an inclined cyclone cover wall and similarly inclined inlet pipe connections results in an extremely advantageous manner in relatively low pressure losses in the gas stream, above all for the cyclone separators. In order to exploit this particularly effectively in a suspension preheater in which the kiln exhaust gas pipe leading from the kiln to the lowest cyclone separator is at the same time constructed as a calciner, it has proved particularly advantageous for the mouth end of the loop-shaped section of the kiln exhaust gas pipe as well as the inlet pipe connection and the cyclone cover wall of this lowest cyclone separator to be constructed with an inclination falling the gas flow direction. On the other hand, however, it has proved particularly advantageous for the inlet pipe connections and the cyclone cover walls in all the other cyclone separators, that is to say in the stages above the lowest cyclone separator, to be provided with an inclination rising in the gas flow direction. This creates a particularly good precondition for constructing each of the gas pipes connected to the inlet pipe connections of these other cyclone separators with a reduced bend, e.g. with a bend which has an arc segment of less than 90°, so that as a result these bends can be simplified from the purely constructional point of view and thus by contrast with most conventional 90° bends have a lower pressure loss for the gas stream which also continues in the cyclone separator as a result of the construction according to the invention.

Furthermore, by advantageous construction and arrangement of dip tubes or dip tube collars (as extensions of the gas outlet pipes protruding into the upper parts of the cyclones) a particularly high degree of dust collection can also be provided for in the cyclone separators constructed according to the invention.

The invention will be explained below in greater detail with the aid of the drawings. In these drawings.

Figure 1:
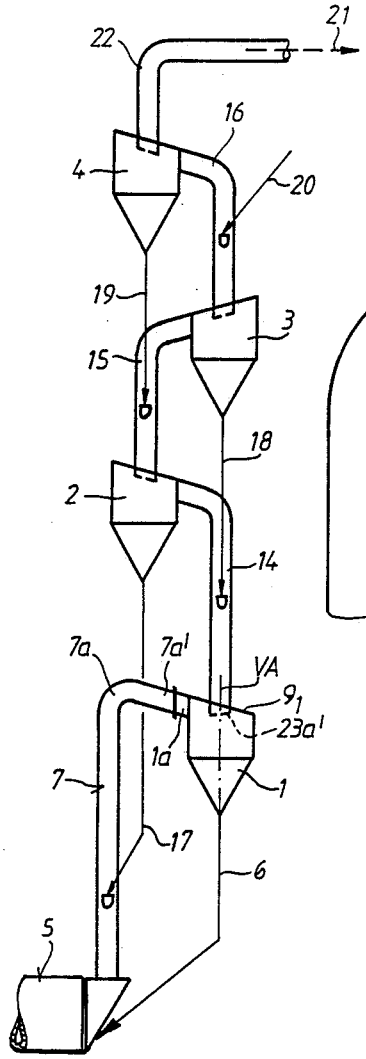
FIG. 1 shows a greatly simplified schematic representation of a suspension heat exchanger constructed as a suspension preheater with a calciner.

According to FIG. 1 the suspension preheater contains a plurality of cyclone separators arranged vertically axially in stages one above the other, with a kiln constructed for example as a rotary kiln 5 for the preheated cement raw meal associated with or connected before the suspension preheater. The lowest cyclone separator 4 of the preheater is connected to the rotary kiln 5 on the one hand via a material pipe 6 and on the other hand via a kiln exhaust gas pipe 7. This kiln exhaust gas pipe 7 can at the same time be constructed (in a manner which is known per se and therefore does not require detailed explanation) as a calciner for the cement raw meal preheated in the individual cyclone stages. The upper section **7*a* of the kiln exhaust gas pipe 7 is curved approximately in a loop shape—as indicated in FIG. 1—and it opens into the inlet pipe connection 1*a* of this lowest cyclone separator 1** with one approximately straight end which is inclined at an angle downwards.

Figure 2:
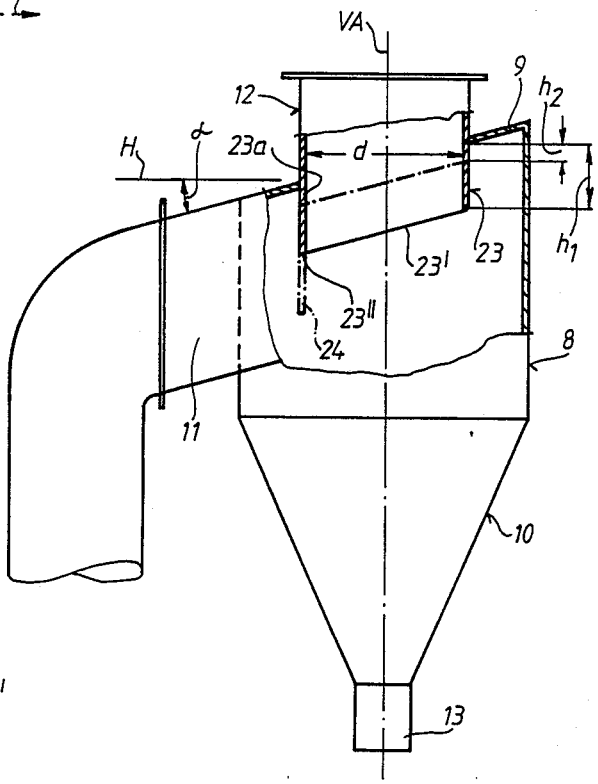
FIG. 2 shows a partially cut-away view of an upper cyclone separator of the suspension preheater.

As can be seen in particular from FIG. 2, all the cyclone separators 1, 2, 3, 4 each contain a substantially straight and preferably largely cylindrical upper part 8 with a flat (plane) cyclone cover wall 9 as well as a funnel-shaped lower part 10 which is connected coaxially to the upper part, an inlet pipe connection 11 which opens approximately tangentially (cf. FIG. 3) into the upper part 8 for the gas-material mixture, and also a gas outlet pipe 12 leading upwards out of the region of the cyclone cover wall 9 and a material outlet pipe 13 connected to the lower end of the lower part 10. As can be seen in FIG. 1, the cyclone separators 1 to 4 are connected one below another by gas pipes 14 to 16 and by material pipes 17 to 19, these gas pipes 14 to 16 being connected to the corresponding inlet pipe connections 11 and gas outlet pipes 12 and the material pipes 17 to 19 being connected to the corresponding material outlet pipes 13 on the one hand and to the gas pipes of the next lower cyclone stage on the other hand in a manner which is generally known per se; the kiln exhaust gas pipe 7 and the material pipe 6 of the lowest cyclone separator 8 should also be mentioned here, as already described above. The cement raw meal which is to be heated is delivered to the uppermost cyclone separator 4 according to the arrow 20 via the appertaining gas pipe 16, whilst the exhaust gas (broken arrow 21) is drawn off via an exhaust gas pipe 22 from the uppermost cyclone separator 4.

To this extent all the cyclone separators 1 to 4 have basically the same construction features, as the cyclone end walls 9 and the inlet pipe connections 11 (or **1*a*** in the lowest cyclone) are inclined a the same acute angle $\alpha$ with respect to the horizontal H, as can be seen both in FIG. 2 and in the representations of the cyclones in FIG. 1. The said angle of inclination $\alpha$ of the cyclone cover walls and inlet pipe connections can be approximately 5° to 45°; in practice, however, it can be approximately 12° to 20°, preferably about 15°.

Both in the representation in FIG. 1 and in the representation in FIG. 2 it can be clearly seen that the end of the appertaining incoming gas pipe 7, 14, 15 or 16 connected to the inlet pipe connection 1*a* or 11 of each cyclone separator 1 to 4 respectively is essentially inclined at the same angle and in the same direction as the appertaining inlet pipe connection.

As can be seen from FIG. 1, the mouth end 7*a*′ of the loop-shaped section 7*a* of the kiln exhaust gas pipe 7 as well as the inlet pipe connection 1*a* and the cyclone cover wall $9_1$ of the lowest cyclone separator 1 have an incline falling in the gas flow direction. By contrast, the inlet pipe connections 11 and the cyclone cover walls 9 of all the other cyclone separators 2 to 4 have an inclination rising in the flow direction, as can be seen from FIG. 2 as well as FIG. 1.

Some special details of the construction of the cyclone separators will be explained in greater detail below, particularly with the aid of FIGS. 2 and 3, and it may be assumed that the cyclone separator shown in FIG. 2 is one of the other cyclone separators 2 to 4 arranged above the lowest cyclone separator 1.

In the case of cyclone separators for such heat exchangers, especially suspension preheaters, it is basically known for the gas outlet pipes of the cyclone separators provided in the cooler region of the heat exchanger to be extended coaxially downwards by dip tubes which project into the upper part. Accordingly, it may be assumed in the present example that the two cyclone separators 3, 4 lying in the cooler preheater region are each equipped with such a dip tube, as shown in particular in FIG. 2 with the reference numeral 23 and in solid lines. This dip tube 23 protrudes a sufficient vertical distance $h_1$ from the cyclone cover wall 9 downwards into the top part 8 to such an extent that a reliable material separation is ensured. The vertical distance $h_1$ (FIG. 2) of this dip tube 23 can be approximately 0.3 to 1.0 times, preferably approximately 0.35 to 0.5 times the internal diameter of the dip tube and thus also of the gas outlet pipe 12 connected at the top thereof.

In the previously known heat exchangers the cyclone separators generally do not have a dip tube in the hotter region of the preheater because considerable problems arise here as regards the operational life of these dip tubes, particularly as a result of the high thermal stresses.

However, in this construction according to the invention it is preferred for the gas outlet pipes 12 of the cyclone separators 1 and 2 in the hotter region of the heat exchanger are allowed to protrude into the upper part 8 of the cyclone only in the form of a relatively short dip tube collar, as indicated at 23*a* in FIG. 2 by a dash-dot line. The length of such a dip tube collar 23*a* corresponds approximately to 0.05 to 0.2 times, preferably approximately 0.07 to 0.15 times the value of the diameter d of this dip tube collar, this diameter d in turn corresponding to the diameter of the gas outlet pipe 12 connected at the top.

As can be seen above all in FIG. 2, the lower end both of the dip tube 23 and of the dip tube collar 23*a* are cut off at an angle so that in both cases an orifice (cf. for example 23′) is produced which lies in a plane running substantially parallel to the cyclone cover wall 9. This situation is also shown in the upper cyclones 2 to 4 in FIG. 1, i.e. in the cyclone separators in which the mouth end of the rising gas pipes 14 to 16 and the inlet pipe connections 11 and the cyclone cover walls 9 are inclined upwards in the gas flow direction. In this way that dip tube 23 or the dip tube collar 23*a* is rotated about the vertical tube axis VA in such a way that the lowest point, e.g. 23″, of each dip tube and dip tube collar in the appertaining upper part 8 of the cyclone is always approximately facing the region of the inlet opening 11′ of the inlet pipe connection 11.

If, on the other hand, we consider the lowest cyclone in FIG. 1, in which the mouth end 7*a*′ of the loop-shaped section 7*a* of the kiln exhaust gas pipe 7 as well as the inlet pipe connection 1*a* and the cyclone cover wall $9_1$ are inclined downwards, then in the sense of a favourable material separation it would have a negative effect if the plane of the orifice of the dip tube collar 23*a*′ located there were also to run parallel to the cover wall $9_1$. In this case the mouth end of the dip tube collar 23*a*′ which is cut off at an angle is also rotated about the vertical tube axis VA so that in turn the deepest point of this dip tube collar 23*a*′ is approximately facing the region of the intake of the inlet pipe connection 1*a* located there, which can be easily visualised by a comparison between the representation in FIG. 1 and the representation in FIG. 2 without any additional explanatory drawing.

Moreover, in any case it can also be advantageous if in each cyclone separator 1 to 4 the appertaining dip tube 23*a* or 23*a*′ has a downwardly-directed apron-like extension on its peripheral region facing the intake of the inlet pipe connection 11 or 1*a* and the peripheral section of the inlet of the upper part 8 of the cyclone, as is merely indicated by dash-dot lines at 24 in FIG. 2.

Figure 3:
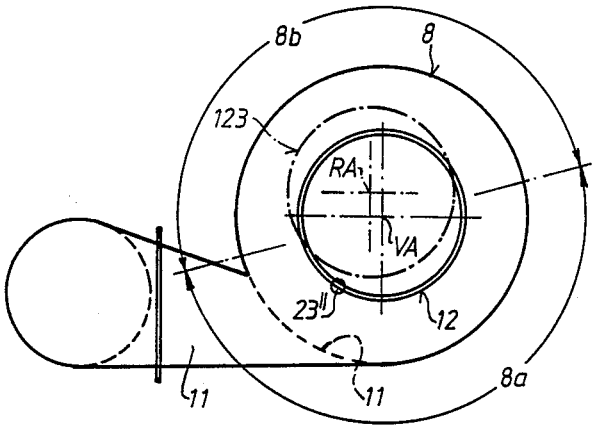
FIG. 3 shows a plan view of the cyclone separator according to FIG. 2.

In the representation in solid lines in FIGS. 1 to 3, the vertical tube axes of the dip tubes 23 and the dip tube collar 23*a* or 23*a*′ in each case coincide with the appertaining vertical cyclone axes which are shown by the dash-dot lines VA.

With the aid of the plan or ground view of a cyclone separator in FIG. 3 it will be explained below that, moreover, it can also be advantageous to offset the dip tubes and/or the dip tube collars eccentrically in the appertaining upper part 8 of the cyclone, but otherwise the same constructions and arrangements of the dip tubes and the gas outlet pipes connected at the top thereof (as explained above) can be retained. This eccentric off-setting of the dip tube or dip tube collar is shown by dash-dot lines in FIG. 3 and is designated by 123. According to this the dip tube 123 shown there (seen in the plan view of the cyclone separator) is offset eccentrically in the appertaining upper part 8 towards the peripheral section 8*b* lying approximately opposite the peripheral section of the inlet 8*a*. The vertical tube axis RA of the dip tube 123 (or a corresponding dip tube collar) runs with appropriate spacing parallel to the appertaining vertical cyclone axis VA, and the vertical tube axis of the appertaining gas outlet pipe in turn advantageously coincides with the vertical tube axis RA of the dip tube 123.

As a result of this eccentric offsetting of the dip tube 123 (or a corresponding dip tube collar) a larger free space is produced in the peripheral section of the inlet 8*a* of the upper part 8 of the cyclone, which initially produces a relatively low pressure loss for the gas stream. When the gas stream then undergoes a rotation of approximately 180° into the somewhat narrower-seeming space and enters the region of the other peripheral section 8*b*, this is no longer detrimental as regards the pressure loss since there the gas stream already flows to a significant extent on its initially downward helical course towards the lower part 10 of the cyclone. This construction is also advantageous as it provides a particularly good degree of dust collection.

Whereas the heat exchanger according to FIG. 1 is constructed particularly as a suspension preheater with a calciner, it goes without saying that a suspension heat exchanger with the cyclone separators constructed and assembled according to the invention can also be produced without a calciner (and without a calcination loop), i.e. it then consists merely of quite identical cyclones corresponding to the cyclone separators 2 to 4 in FIG. 1 or the one according to the representation in FIG. 2. In addition, a suspension heat exchanger composed of the cyclone separators according to FIG. 2 can be adapted and used not only for heating fines in powder form and in fine-grained form, but also—as is known per se—for cooling fines.

It also goes without saying that the upper part of the cyclone separators can also be constructed in the substantially straight cylindrical form—deviating somewhat from the representation in FIGS. 2 and 3—so that the inlet pipe connection for the gas-material mixture which is connected approximately tangentially to it can also be connected to it helically, i.e. at the upper end of the upper part of the cyclone the inlet pipe connection is connected via a corresponding peripheral section in the form of an inlet spiral, and this upper peripheral section of the upper part—in plan view—is reduced helically from the inlet orifice to the connection to the remaining cylindrical section (as is known per se).

We claim:

1. Suspension preheater for heat exchange between gas and fines before a kiln (5), containing (a) a plurality of cyclone separators (1 to 4) lying one above another with their axes arranged approximately vertically and each having ($a_1$) an essentially straight upper part with a flat cyclone cover wall (9, $9_1$), ($a_2$) a lower part (10) which is axially connected to the upper part, ($a_3$) an inlet pipe connection (1*a*, 11) which opens approximately tangentially into the upper part for a gas-material mixture, ($a_4$) a gas outlet pipe (12) leading upwards from the region of the cyclone cover wall (9, $9_1$) and ($a_5$) a gas outlet pipe (13) connected to the lower end of the lower part (10), (b) gas and material pipes (14 to 16, 17 to 19) which connect the cyclone separators (1 to 4) one below another and which for their part are connected to the corresponding inlet pipe connections as well as gas and material outlet pipes of the cyclones, (c) a kiln exhaust gas pipe (7) which connects at least the lowest cyclone separator (1) to the kiln (5) and is at the same time constructed as a calciner, the upper section of the said pipe (7) being bent in a loop and opening into the gas inlet pipe connection (1*a*) of the lowest cyclone separator, characterised in that the cyclone cover wall (9, $9_1$) and the inlet pipe connection (1*a*, 11) of each cyclone separator (1 to 4) are inclined at an acute angle ($\alpha$) with respect to the horizontal (H), and the mouth end (7*a*′) of the loop-shaped section (7*a*) of the kiln exhaust gas pipe (7) as well as the inlet pipe connection (1*a*) and the cyclone cover wall ($9_1$) of the lowest cyclone separator (1) have an inclination ($\alpha$) which falls in the gas flow direction, whereas the inlet pipe connections (11) and the cyclone cover walls (9) of all the other cyclone separators (2 to 4) have an inclination ($\alpha$) rising in the gas flow direction.

2. Suspension preheater as claimed in claim 1, characterised in that the angle of inclination of the cyclone cover wall (9, $9_1$) and the inlet pipe connection (1*a*, 11) is approximately 5° to 45°, preferably approximately 12° to 20°.

3. Suspension preheater as claimed in claim 1, characterised in that the end of the appertaining incoming gas pipe (7, 14 to 16) connected to the inlet pipe connection (1*a*, 11) of each cyclone separator is inclined at substantially the same angle and in the same direction as the inlet pipe connection.

4. Suspension preheater as claimed in claim 1, in which at least the gas outlet pipe (12) of the cyclone separators (3 and 4) provided in the cooler region of the preheater are extended coaxially downwards by the dip tubes (23, 123) which protrude into the upper parts (8), characterised in that the gas outlet pipes of the cyclone separators (1, 2) provided in the hotter region of the preheater are only extended into the upper part (8) of the cyclone in the form of a relatively short dip tube collar (23*a*), and the length ($h_2$) of the dip tube collar (23*a*) corresponds approximately to 0.05 to 0.2 times, preferably approximately 0.07 to 0.15 times the value of the diameter (d) of this dip tube collar.

5. Suspension preheater as claimed in claim 4, characterised in that the orifice (23′) of the lower end both of the dip tubes (23) and of the dip tube collars (23*a*) lies in a plane which extends substantially parallel to the cyclone cover wall (9).

6. Suspension preheater as claimed in claim 4, characterised in that the lower mouth end both of the dip tubes and of the dip tube collars is cut off at an angle, and the dip tubes (23, 23*a*, 23*a*′) are rotated about their tube axis (VA) in such a way that the lowest point (23″) of each dip tube and dip tube collar in the appertaining upper part (8) of the cyclone is approximately facing the intake (11′) of the inlet pipe connection (11, 1*a*).

7. Suspension preheater as claimed in claim 4, characterised in that in each cyclone separator (1 to 4) the appertaining dip tube (23) or the appertaining dip tube collar (23*a*) has a downwardly-directed apron-like extension (24) on its peripheral region facing the intake (11′) of the inlet pipe connection (11, 1*a*) and the peripheral section of the inlet (8*a*) of the upper part (8) of the cyclone.

8. Suspension preheater as claimed in claim 4, characterised in that the vertical tube axes (VA) of the dip tubes (23) and of the dip tube collars (23*a*, 23*a*′) coincide with the appertaining vertical cyclone axes (VA).

9. Suspension preheater as claimed in claim 4, characterised in that the dip tubes (123) and dip tube collars—in plan view of the cyclone separators—are offset eccentrically in the appertaining upper part (8) towards the peripheral section (8*b*) lying approximately opposite the peripheral section of the inlet (8*a*), and their vertical tube axes (RA) run parallel to the appertaining vertical cyclone axes (VA).

* * * * *